US008966791B2

(12) United States Patent
Horton

(10) Patent No.: US 8,966,791 B2
(45) Date of Patent: Mar. 3, 2015

(54) STAGGERED EDGE EXCAVATOR BUCKETS

(71) Applicant: Lee A. Horton, Jefferson, MA (US)

(72) Inventor: Lee A. Horton, Jefferson, MA (US)

( * ) Notice: Subject to any disclaimer, the term of this patent is extended or adjusted under 35 U.S.C. 154(b) by 0 days.

(21) Appl. No.: 14/265,499

(22) Filed: Apr. 30, 2014

(65) Prior Publication Data

US 2014/0230292 A1 Aug. 21, 2014

Related U.S. Application Data

(63) Continuation-in-part of application No. 12/958,761, filed on Dec. 2, 2010.

(60) Provisional application No. 61/265,988, filed on Dec. 2, 2009.

(51) Int. Cl.
*E02F 3/40* (2006.01)
*E02F 9/28* (2006.01)

(52) U.S. Cl.
CPC ..... *E02F 3/40* (2013.01); *E02F 9/2858* (2013.01)
USPC ..... 37/444; 37/446

(58) Field of Classification Search
CPC ..... E02F 3/40; E02F 9/2858
USPC ..... 37/411, 443, 444, 446; 414/722
See application file for complete search history.

(56) References Cited

U.S. PATENT DOCUMENTS 2,405,811 A 8/1946 Beyer
2,615,262 A 10/1952 Reid, Sr.
2,660,323 A 11/1953 Carlesimo
2,838,856 A 6/1958 Buisse
2,864,184 A 12/1958 Fohr
2,972,425 A 2/1961 Anderson et al.
3,032,900 A 5/1962 Kashergen
3,130,843 A 4/1964 Kelly
3,724,899 A 4/1973 Clark
3,885,833 A 5/1975 Lemieux
4,037,337 A 7/1977 Hemphill
4,038,766 A 8/1977 Felstet
4,041,624 A 8/1977 Fryrear
4,077,529 A 3/1978 Leyrat et al.
4,117,611 A 10/1978 Hemphill
4,123,861 A 11/1978 Hemphill (Continued)

OTHER PUBLICATIONS

"Couplers and Attachments for Construction Attachments";DigNRipBucket; Leading Edge Attachments, Inc.; 2002-2004.

(Continued)

*Primary Examiner* — Jamie L McGowan
(74) *Attorney, Agent, or Firm* — Fish & Richardson P.C.

(57) ABSTRACT

A staggered edge bucket excavation tool has a body formed by side-leading edge plates, a back sheet, and a plate with a front leading edge spanning a region of the bucket between edge plates. The tool defines a volume for receiving material excavated from a hard packed substrate. Two or more teeth may be mounted along the front leading edge, with each tooth defining a forward surface non-aligned with forward surfaces of all other teeth, thereby disposed for individual, sequential initial engagement with the substrate during excavation. The teeth define a flat plane generally parallel to the planar plate. Each tooth defines an excavation angle between a surface of the tooth and the axis of rotation, and the excavation angle of each tooth being different from excavation angles of all other teeth. In implements, the front leading edge defines multiple edge portions or defines a single multiple edge portion.

2 Claims, 6 Drawing Sheets

(56) References Cited

U.S. PATENT DOCUMENTS

| | | | |
|---|---|---|---|
| 4,133,121 | A | 1/1979 | Hemphill |
| 4,204,348 | A | 5/1980 | Lydie |
| 4,204,349 | A | 5/1980 | Tallis |
| 4,217,962 | A | 8/1980 | Schaefer |
| 4,238,896 | A | 12/1980 | Lanz et al. |
| 4,279,085 | A | 7/1981 | Arnold |
| 4,314,789 | A | 2/1982 | Luigi |
| 4,321,762 | A | 3/1982 | Hemphill |
| 4,351,397 | A | 9/1982 | Winker |
| 4,457,085 | A | 7/1984 | Arnold |
| 4,476,641 | A | 10/1984 | Bellinger |
| 4,516,339 | A | 5/1985 | Hemphill |
| 4,576,239 | A | 3/1986 | Launder |
| 4,616,433 | A | 10/1986 | Knell et al. |
| 4,719,711 | A | 1/1988 | Sieber et al. |
| 4,808,027 | A | 2/1989 | Anderson |
| 4,845,867 | A | 7/1989 | Albrecht |
| 4,896,444 | A | 1/1990 | Sieber et al. |
| RE33,198 | E | 4/1990 | Bellinger |
| 5,016,365 | A | 5/1991 | Robinson |
| 5,084,990 | A | 2/1992 | Briscoe |
| 5,350,022 | A | 9/1994 | Launder et al. |
| 5,412,885 | A | 5/1995 | Cornelius |
| 5,456,028 | A | 10/1995 | Larson |
| 5,595,471 | A | 1/1997 | Ajilore |
| 5,815,959 | A | 10/1998 | Bahner et al. |
| 5,901,479 | A | 5/1999 | Langdon |
| 5,992,062 | A | 11/1999 | Evans et al. |
| 6,290,451 | B1 | 9/2001 | Ihm |
| 6,328,114 | B1 | 12/2001 | Ritchie et al. |
| 6,581,308 | B1 | 6/2003 | Woerman et al. |
| 6,626,499 | B1 | 9/2003 | Schenk et al. |
| 7,191,553 | B2 | 3/2007 | Doucette et al. |
| D553,162 | S | 10/2007 | Cazes |
| 7,484,323 | B2 | 2/2009 | Morin |
| 7,617,619 | B2 | 11/2009 | Cox |
| 7,739,815 | B2 | 6/2010 | Horton |
| 2004/0060208 | A1 | 4/2004 | Wagner |
| 2004/0148820 | A1 | 8/2004 | Horton |
| 2006/0070267 | A1 | 4/2006 | Horton |
| 2009/0183398 | A1 | 7/2009 | McClallen et al. |

OTHER PUBLICATIONS

"Wain Roy™ Ripper Bucket™"; Woods Equipment Company; 1998.
Wain-Roy® Ripper Bucket™ for Severe Digging; Wain Roy® Inc.

STAGGERED EDGE EXCAVATOR BUCKETS

PRIORITY

This application is a continuation-in-part of U.S. patent application Ser. No. 12/958,761, filed Dec. 2, 2010, now pending, which claims benefit from U.S. Provisional Application No. 61/265,988, filed Dec. 2, 2009, now expired. The complete disclosures of both applications are incorporated herein by reference.

TECHNICAL FIELD

This disclosure relates to excavation tools, and more particularly to bucket type excavation tools, for excavators, backhoes, and wheel, crawler and skid-type loaders.

BACKGROUND

Excavation tools of the types described herein are typically mounted to conventional excavators of the type having a backhoe, or mounted to a conventional loader with a pair of boom arms. The backhoe version includes a dipper stick, and the tool is mounted on the outboard end of the dipper stick. The loader version would include boom arms of wheel loaders, crawler loaders and skid steer loaders where the tool is mounted to the outboard end of the boom arms. These tool types are employed for excavation of medium packed substrate, e.g. substrate between the category of loose soil or loose gravel and the category of substrate requiring a ripper or hammer. Medium packed substrate does not usually require special tools or rippers to be excavated; however, conventional buckets that have teeth horizontally aligned do not excavate efficiently. Loose soil or gravel can be excavated with a conventional bucket, but a conventional bucket is generally not efficient in hard packed substrate. Solid rock excavation generally requires a hydraulic hammer, but a hydraulic hammer is not efficient for excavating hard packed substrate because it is slow and requires an additional bucket to remove the material. Intermediate substrate excavation generally requires a ripper, but a ripper may not be efficient for excavating hard packed substrate because it requires an additional bucket to remove the material. Intermediate substrate excavation also generally requires a ripper bucket combination, e.g., similar to that described in Horton, U.S. Pat. No. 7,322,133, entitled "Multi-Shank Ripper", the complete disclosure of which is incorporated herein by reference, but a ripper bucket combination is considerably more expensive and may not be efficient for excavating hard packed substrate because it generally has a small capacity and it is not flat on the bottom for easily forming flat trench bottoms. Excavation projects generally require that the bottom of the excavated hole or trench be flat. Attempts have been made to develop tools that are effective, inexpensive, and efficient in excavating hard packed substrate while making the trench bottom flat. Simply stated, there has been one general approach, i.e. the spade nose bucket approach, e.g. as described in Evans et al., U.S. Pat. No. 5,992,062, entitled "High Penetration Bucket Arrangement," and replaceable versions, e.g. as described in Grant, U.S. Pat. No. 7,266,914, entitled "Wear Plate Assembly," and versions thereof, the complete disclosures of which are incorporated herein by reference. Evans et al. describes a forward center tooth that makes penetration engagement with the soil prior to the side teeth and side teeth assemblies that will engage the material at the same time. This arrangement provides for good penetration and efficiency when the first center tooth engages; however, as soon as the two outer tooth assemblies engage with the soil, the efficiency drops and the soil resistance becomes dramatically higher. Grant also described a spade nose type bucket for a loader; however, the front leading edge contains a replaceable spade nose wear portion. This design also provides good penetration when the first center tooth engages; however, as soon as the subsequent multiple side teeth engage, the efficiency drops dramatically as the teeth engage in pairs. These teeth also align with each other when viewed from the side. Each of these approaches has been found to have drawbacks.

SUMMARY

According to a first aspect of the disclosure, a staggered edge excavation tool for use mounted to an arm of an excavation machine and having an axis of rotation relative to the arm comprises a body mounted for rotation from the arm, a pair of generally flat, side leading edge plates mounted to the body, a formed back sheet mounted to said body and to the side leading edge plates, and a planar plate having a staggered front leading edge, the planar plate being mounted to span the region of the staggered edge bucket between the side leading edge plates, and attached to the formed back sheet and the side plates, to define, together, a staggered edge bucket volume for receiving material excavated from a hard packed substrate during excavation action. Also included is a set of two of more teeth mounted along the staggered front leading edge of the planar plate, wherein each tooth of the set of two or more teeth defines a forward surface non-aligned with the forward surfaces of all other teeth of the set of two or more teeth and thereby disposed for individual, sequential initial engagement with the hard packed substrate during excavation action, and the set of two or more teeth defines a flat plane that is generally parallel to the planar plate. Each tooth of the set of two or more teeth defines an excavation angle measured between a surface of the tooth and the axis of rotation, and the excavation angle of each tooth of the set of two or more teeth is different from the excavation angles of all other teeth of the set of two or more teeth.

Preferred implementations of the disclosure may include one or more of the following additional features. The staggered front leading edge of the planar plate defines scalloped front leading edge segments between teeth of the set of two or more teeth. The set of two or more teeth comprises at least three teeth, with each tooth equally spaced along the staggered front leading edge of the planar plate from every adjacent tooth. The front leading edge defines multiple edge portions, the multiple edge portions being disposed at contrasting angles relative to the direction of substrate engagement motion, e.g., the front leading edge is a staggered edge having two edge portions. The front leading edge defines a single multiple edge portion, the single portion being disposed at a predetermined angle relative to the direction of substrate engagement motion.

Preferred implementations of this aspect of the disclosure may also or instead include one or more of the following additional features. The excavation teeth are replaceably mounted to the tool. The excavation teeth are integral with the tool. The body portion comprises a body upper portion and a body tubular cross brace portion. Each excavation tooth comprises a weld-on adapter. Each excavation tooth has a top cutting surface and a bottom surface. Each excavation tooth terminates in a tip, and the first excavation tooth top cutting surface is disposed at a predetermined angle to the line through the arm pivot. The predetermined angle is between about 20° and about 50° from the tangent. The excavation teeth can be any standard or special style of excavation teeth.

A tip radius dimension between the dipper stick pivot and each excavation tooth tip is about the same as a tip radius dimension of a conventional bucket.

Preferred implementations of this aspect of the disclosure may also or instead include one or more of the following additional features. The first excavation tooth is linearly advanced relative to the second excavation tooth in a direction of substrate excavation motion, whereby the first excavation tooth is engaged for excavating the substrate before the second excavation tooth is engaged for excavating the substrate. The tool further comprises additional teeth, for excavation engagement with a substrate, each additional tooth being laterally spaced from each other shank along the axis of rotation of the staggered edge excavation tool relative to the arm, and the excavation tooth of each additional tooth being linearly spaced from the excavation tooth of each other of the additional shanks in a direction of excavation motion. The excavation tooth is replaceably mounted to the tool. The excavation tooth is integral with the tool.

Preferred implementations of this aspect of the disclosure may further or instead include one or more of the following additional features. A front leading edge is staggered spanning both laterally at an angle, and connecting the forward side leading edge and tooth to the rearward side leading edge and tooth. Additional teeth are spaced along the front leading edge. All of the teeth and the front leading edge are positioned generally on a flat plane, providing a flat bottom on the excavation tool that is parallel to the angle of rotation. The forward tooth is set to the optimum excavation angle relative to the axis of rotation.

Preferred implementations of this aspect of the disclosure may still further or instead include one or more of the following additional features. The rearward side leading edge is shaped to support the front leading edge while also limiting side spillage, thus providing for maximum capacity of excavated material.

Preferred implementations of this aspect of the disclosure may include the additional feature of the staggered front leading edge plate including non-aligning teeth mounted thereto.

According to another aspect of disclosure, a method for excavation of a substrate employing a staggered edge excavation tool mounted to an excavation machine comprises the steps of: engaging a first excavation tooth of the staggered edge excavation tool with the substrate surface to be excavated and applying excavation force only to the first excavation tooth to cause the first excavation tooth to penetrate the substrate in excavation action, thereafter, engaging a second excavation tooth of the staggered edge excavation tool with the substrate surface being excavated and applying excavation force to the second excavation tooth to cause the second excavation tooth to penetrate the substrate in excavation action, and thereafter engaging, in succession, succeeding excavation teeth of the staggered edge excavation tool with the substrate surface being excavated and applying excavation force to the succeeding excavation teeth, in succession to cause the succeeding excavation teeth, in succession, to penetrate the substrate in excavation action.

Preferred implementations of this aspect of the disclosure may include one or more of the following additional features. The method comprises the further steps of, as the first excavation tooth penetrates the substrate surface to break out material from the substrate surface, allowing the tool and dipper stick to nosedive until a second excavation tooth engages the substrate surface with full cylinder force; and, as the second excavation tooth penetrates the substrate surface to break out material from the substrate surface, allowing the tool and dipper stick to nosedive until a third excavation tooth engages the substrate surface with full cylinder force. The method may further comprise the step of, as each succeeding excavation tooth, in succession, penetrates the substrate surface to break out material from the substrate surface, allowing the tool and dipper stick to nosedive until a still further succeeding excavation tooth, in succession, engages the substrate surface with full cylinder force.

According to yet another aspect of the disclosure, a method for excavation of a substrate employing a staggered edge excavation tool mounted on a dipper stick of an excavation machine comprises the steps of: (a) extending the dipper stick to full extent forward of the excavation machine and pivoting the excavation tool at the end of the dipper stick back to full extent; (b) lowering the dipper stick until a first excavation tooth of the excavation tool engages the substrate; (c) drawing the excavation tool toward the excavation machine to cause the first excavation tooth to penetrate the substrate surface in excavation action; (d) simultaneously pivoting the excavation tool forward until a second excavation tooth of the excavation tool engages the surface of the substrate being ripped; (e) drawing the excavation tool toward the excavation machine to cause the second excavation tooth to penetrate the substrate surface in excavation action; and (f) repeating steps (d) and (e) for each succeeding excavation tooth of the excavation tool, in succession.

According to yet another aspect of the disclosure, a method for excavation of a substrate employing a staggered edge excavation tool mounted on a dipper stick of an excavation machine comprises the steps of: (a) extending the dipper stick to full extent forward of the excavation machine and pivoting the excavation tool at the end of the dipper stick back so that the flat bottom is parallel to the ground; (b) lowering the dipper stick until the flat bottom of the excavation tool engages the substrate; (c) drawing the excavation tool toward the excavation machine to cause all of the teeth to shave substrate surface in excavation action; (d) simultaneously pivoting the excavation tool rearward thus keeping the bottom flat to the surface of the substrate being excavated; (e) drawing the excavation tool toward the excavation machine to cause the teeth to shave the substrate surface flat in excavation action.

The staggered edge bucket excavation tool described herein outperforms prior art tools, e.g. as described by Evans, et al., because no two teeth are in alignment. Each tooth of the disclosed excavation tool engages the hard packed substrate at different times, thus creating a smooth, higher force concentration as the bucket engages the material. None of the prior excavation tools is as efficient and effective for excavation of hard packed substrate as the staggered edge bucket described herein.

One advantage of the staggered edge excavation tool of this disclosure is realized when working with a top frost layer condition. Since the teeth engage one at a time, the staggered edge excavation tool has the ability to simplify excavation of a top layer of frozen ground due to the concentration of the breakout force on one tooth at a time. Once the top layer is removed, the soft soil underneath can be excavated easily and quickly with the large capacity of this tool. Other ripper/bucket combinations that might function similarly would be on the order of, e.g., four times as expensive, and typically would not have as large a capacity.

A further object of the disclosure is to provide excavation tools and systems that apply maximum working force to the working tooth for efficient and effective excavation of hard packed substrate.

It is another object of the disclosure is to provide excavation tools and systems with smooth operation and minimum stress on an excavating vehicle as it efficiently and effectively excavates hard packed substrate.

It is a further object of the disclosure to provide excavation tools and systems capable of easily forming a flat bottom in the trench or excavated formation of hard packed substrate.

It is a further object of the disclosure to provide excavation tools and systems capable of high quality, large capacity and low cost manufacture, with long and useful service life and, minimum of maintenance.

Drawbacks experienced with the prior art devices have been obviated in a novel manner by the present disclosure. It is, therefore, an outstanding object of the present disclosure to provide excavation tools and systems that efficiently and effectively excavate hard packed substrate.

The details of one or more implementations of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1:
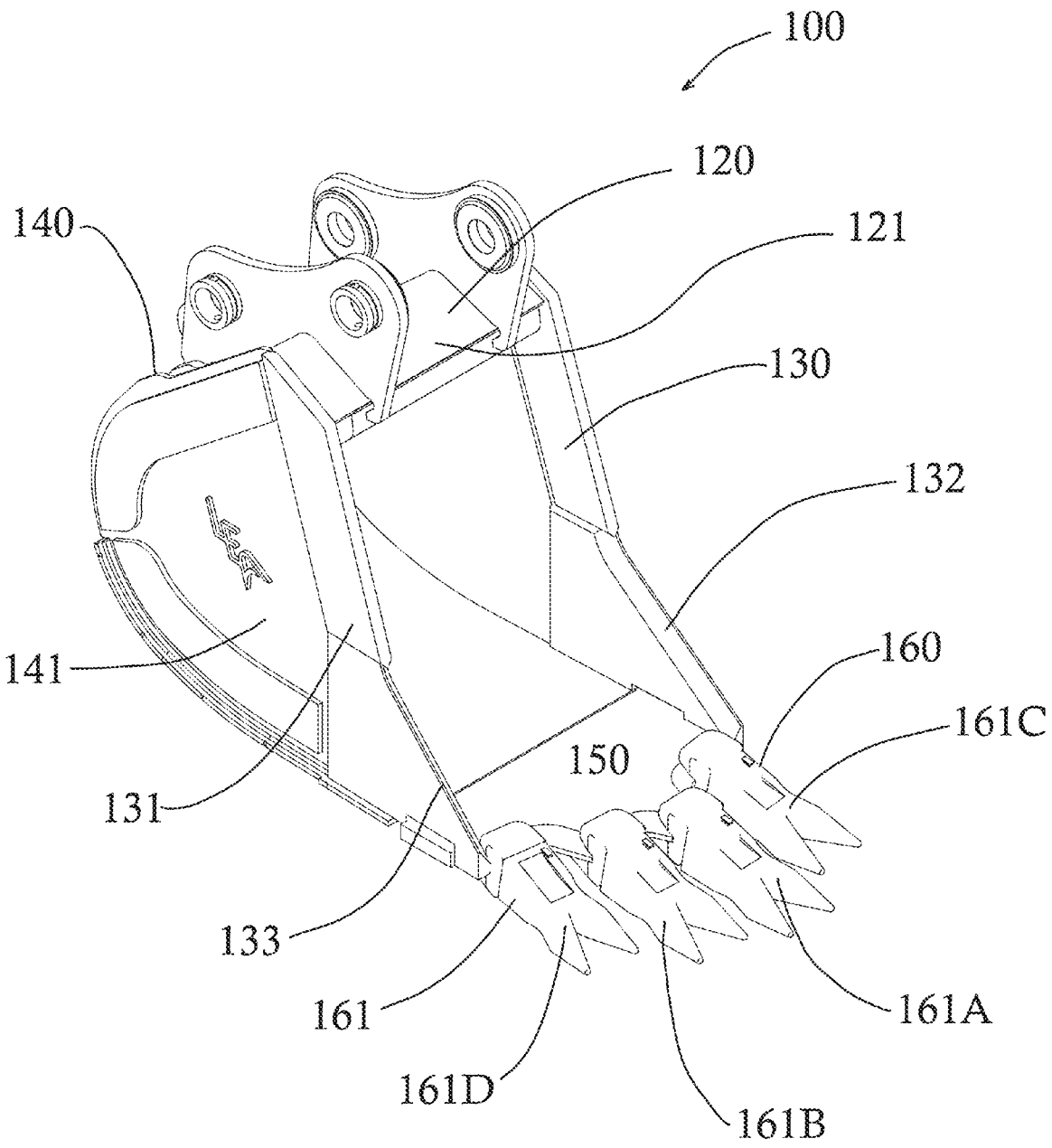
FIG. 1 is a perspective view of a first implementation of a staggered edge excavation tool of the present disclosure having a front leading edge with multiple portions, the multiple portions being disposed at contrasting angles relative to the direction of substrate engagement motion, i.e., a staggered edge, in this case having two edge portions.
Figure 2:
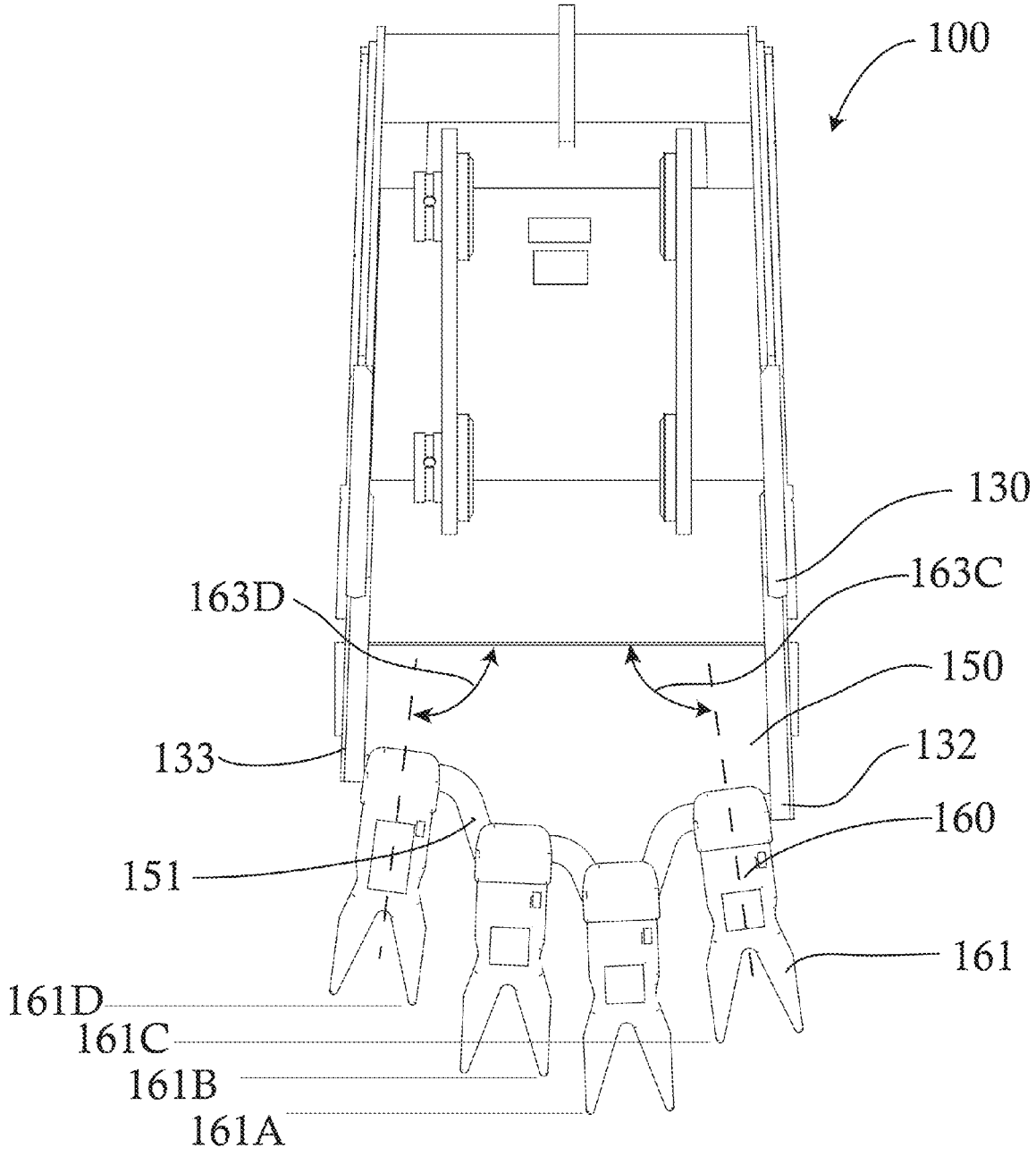
FIG. 2 is a top view of a portion of the excavation tool of FIG. 1.
Figure 3:
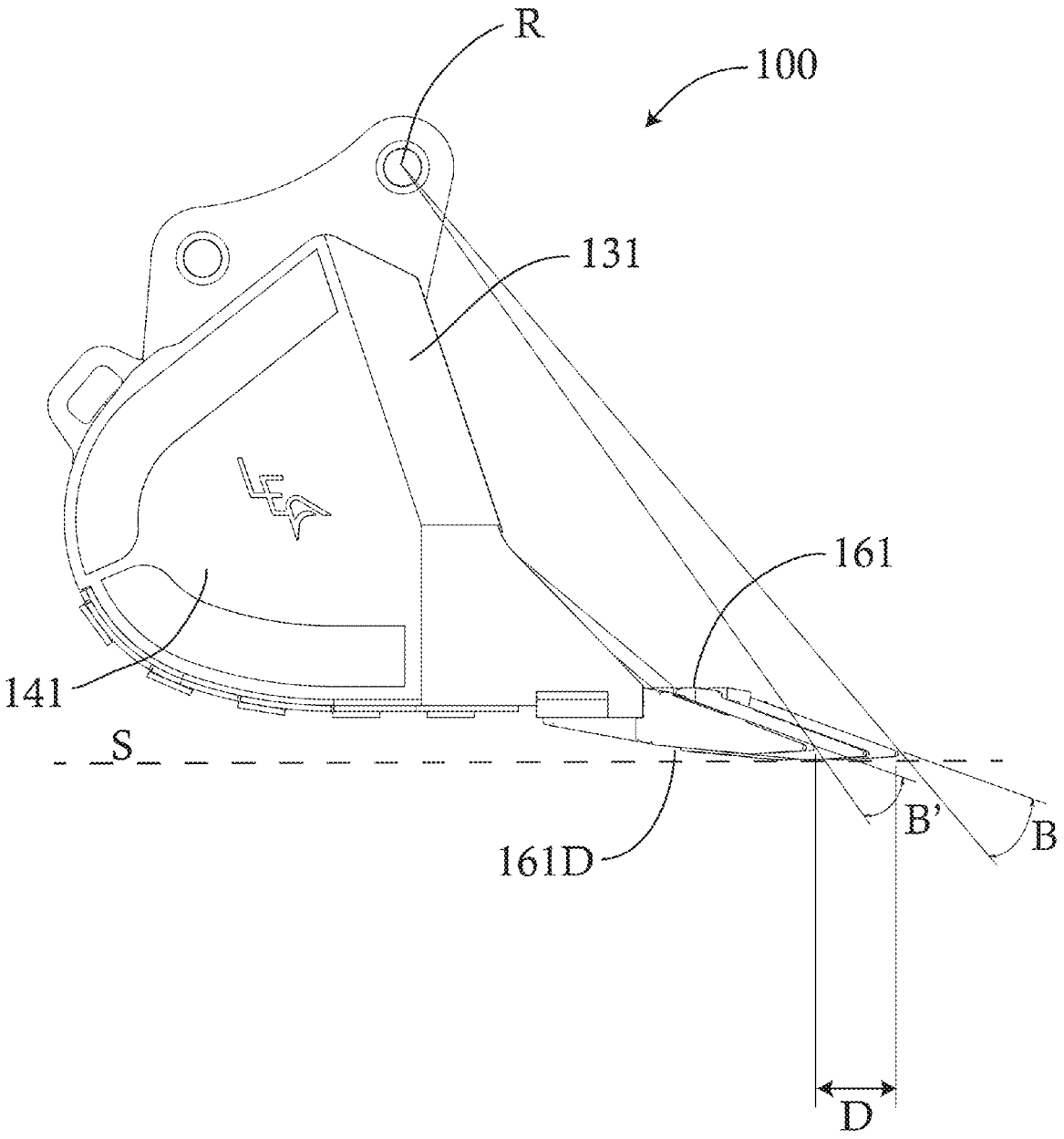
FIG. 3 is a left side view of a portion of the excavation tool of FIG. 1.
Figure 4:
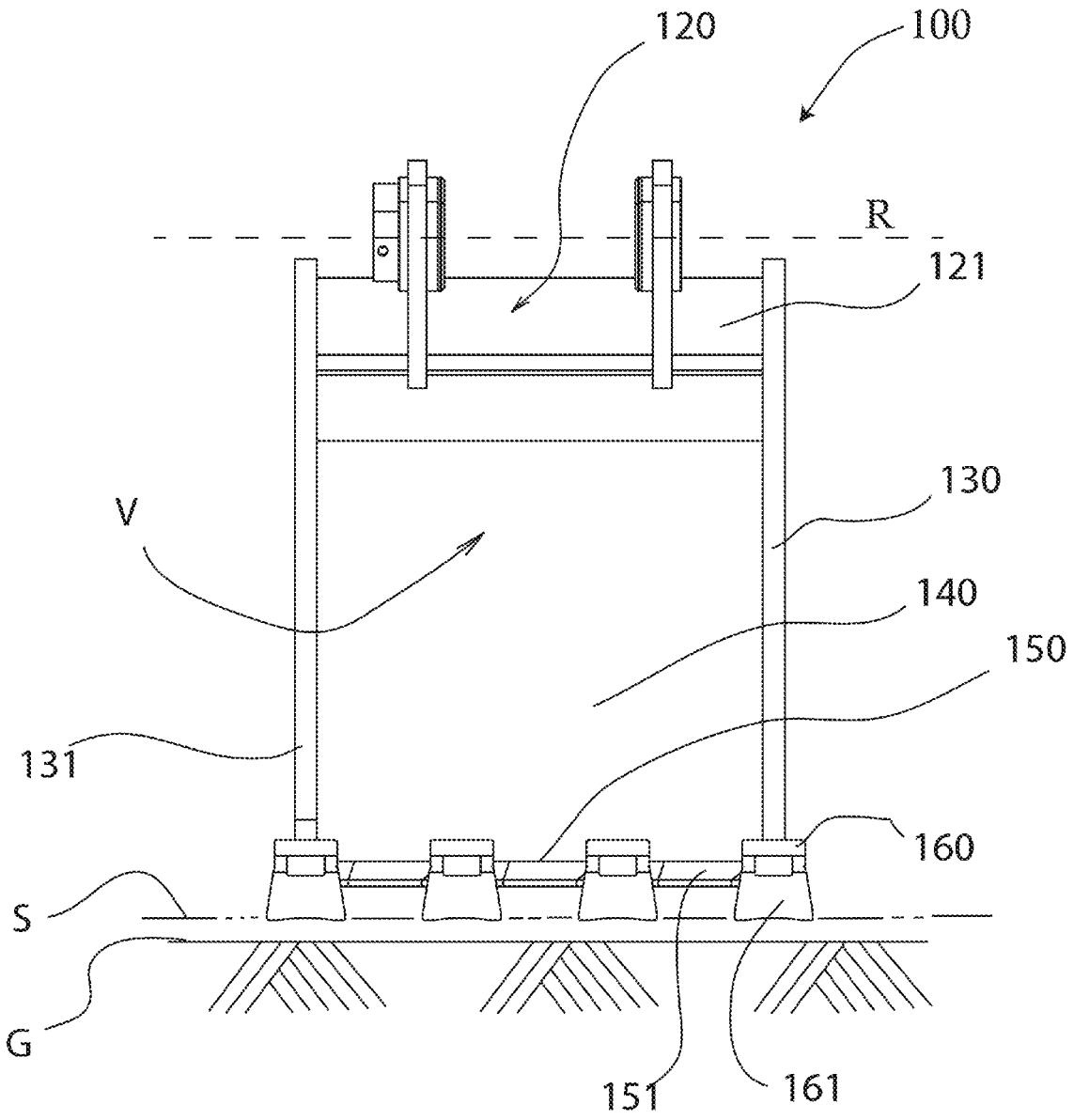
FIG. 4 is a front view of the excavation tool of FIG. 1.

Referring to FIGS. 1-4, a staggered edge excavation tool 100 having a staggered or non-symmetrically angled, multiple portion edge has a body 120 for mounting from an arm (not shown), e.g., a dipper arm or a boom arm, and a set of first and second side leading edge plates 130, 131 mounted to the body. The body 120 consists of two plates 121 that form a tube spanning between the side leading edge plates 130 and 131. Each side leading edge plate 130, 131 is perpendicular to an axis of rotation, R, of the tool, and each side leading edge is connected by a front leading edge plate 150 positioned for engagement with a substrate. Referring to FIG. 2, the front leading edge plate 150 has an irregular, non-symmetrically angled (or staggered) front leading edge 151 with two edge portions at contrasting angles in the directions of substrate engagement motion. The front leading edge plate 150 connects the first side leading edge 132 to the second side leading edge 133 shown in FIG. 1. The staggered front leading edge plate 150 shown in the drawings has mounted teeth 161; however, other implementation may or may not have mounted teeth. The side leading edge plates 130, 131 and teeth 161 are laterally spaced apart along the axis of rotation relative to the arm, and the teeth are positioned in a direction of substrate engagement motion. The first side leading edge 132 and second side leading edge 133 are spaced apart in the direction of bucket motion, and a first tooth 161A positioned foremost in the direction of substrate engagement motion is separated from a rearmost tooth 161D by distance, D', e.g., 11 inches for an 30-inch wide bucket or 15 inches for a 40-inch wide bucket, as shown in FIG. 3. Additional teeth 161 (e.g. 161B and 161C as shown in FIG. 2) may be intermediately spaced along the front leading edge 151 of the front leading edge plate 150. All of the teeth 161 and the front leading edge 151 are positioned generally on a flat plane, S, as shown in FIG. 3, providing a flat bottom on the excavation tool that is generally parallel to the path of rotation. The top of the forward tooth 161A can be set to the optimum excavation angle B, e.g. about 30°, relative to the axis of rotation, R, to provide maximum penetration in the substrate. The front leading edge plate 150 is configured to support tooth adapters 160 (to which teeth 161 are mounted, e.g. by pins), while also limiting side spillage, thus providing for maximum capacity of excavated material. The front leading edge 151 is scalloped to help slice through the hard packed substrate, e.g., as shown in FIG. 2. The scallop segments generate a non-uniform, irregular pattern such that each tooth 161 is positioned at a different distance from the rear of the front edge plate 150.

A curved back plate 140 as shown in FIG. 1 is mounted to span a region between the side leading edge plates 130 and 131, and the side plates 141, providing a bucket volume, V, of predetermined capacity, e.g. 1.2 cubic yards, for receiving material excavated from the substrate. The tip radius and the width of the staggered edge bucket may be similar to conventional buckets in order to maintain capacities that are also similar. As shown in FIG. 2, the teeth 161 arranged on the tooth adaptors 160 may or may not be directly aligned in the direction of substrate engagement, e.g., perpendicular to the axis of rotation R' or to the rear of the front leading edge plate 150. By way of example, the midpoints of teeth 161C and 161D have non-perpendicular angles 163C and 163D, respectively, which are greater than 90 degrees.

The staggered edge bucket 100 of FIG. 1 improves the efficiency of excavating hard packed substrate, e.g., as compared to prior art tools, by focusing the breakout force one tooth at a time, while the flat bottom, as shown in FIG. 3, simplifies the operation of forming a flat bottom in the trench. When the operator is excavating hard packed substrate, the bucket is rolled away from the operator, and then lowered, such that the first tooth 161A engages the material first. The concentration of machine breakout force on one tooth provides a concentration of the forces that are high enough to easily break up hard packed substrate. As the bucket is rolled toward the operator and lowered, the second tooth, e.g., the tooth 161B adjacent to tooth 161A, engages the substrate. Looking only at the second tooth, because the second tooth is closer to the arm bucket pin location of rotation (axis, R'), the force on this tooth will be relatively higher, i.e. than the force on the first tooth, and also because the teeth are positioned in a flat plane, the angle, B', as shown in FIG. 3, for the second tooth, e.g. 32°, is relatively larger than the angle, B, for the first tooth, e.g. the angle for the first tooth is about 30°. This relatively larger angle, B', creates a greater material slicing effect than the smaller angle, B, on the first tooth. Looking at the first and the second tooth together, the first tooth engages with the hard packed substrate with full breakout force. When the second tooth engages the substrate, some of the load is shared with the first tooth. As the bucket continues to be rolled forward the third tooth 161C also adjacent to tooth 161A engages the substrate. As the rolling motion continues, the fourth tooth 161 D immediately adjacent to the second tooth 161B and closest to second side leading edge plate 131 engages the substrate. When all of the teeth have engaged with the substrate, the efficiency is only slightly better than a conventional bucket. Throughout a good portion of the digging of the hard packed substrate, the bucket will have all teeth engaged; however, when the material becomes difficult to dig the operator will know to position the bucket so that relatively fewer teeth are engaged, thus providing relatively higher forces for simplifying the excavation of the hard packed substrate.

The bucket volume, V, of the staggered edge bucket 100 fills and empties easily, permitting the operator to scoop all excavated materials. When the operator has excavated to the bottom of the trench to where he/she would like to produce a flat bottom, the staggered edge bucket can be positioned flat, similar to FIG. 4, and can be forced laterally using the machine hydraulics, to shave the trench bottom material to produce a perfectly flat bottom. This technique is similar to the technique used with a conventional bucket.

Figure 5:
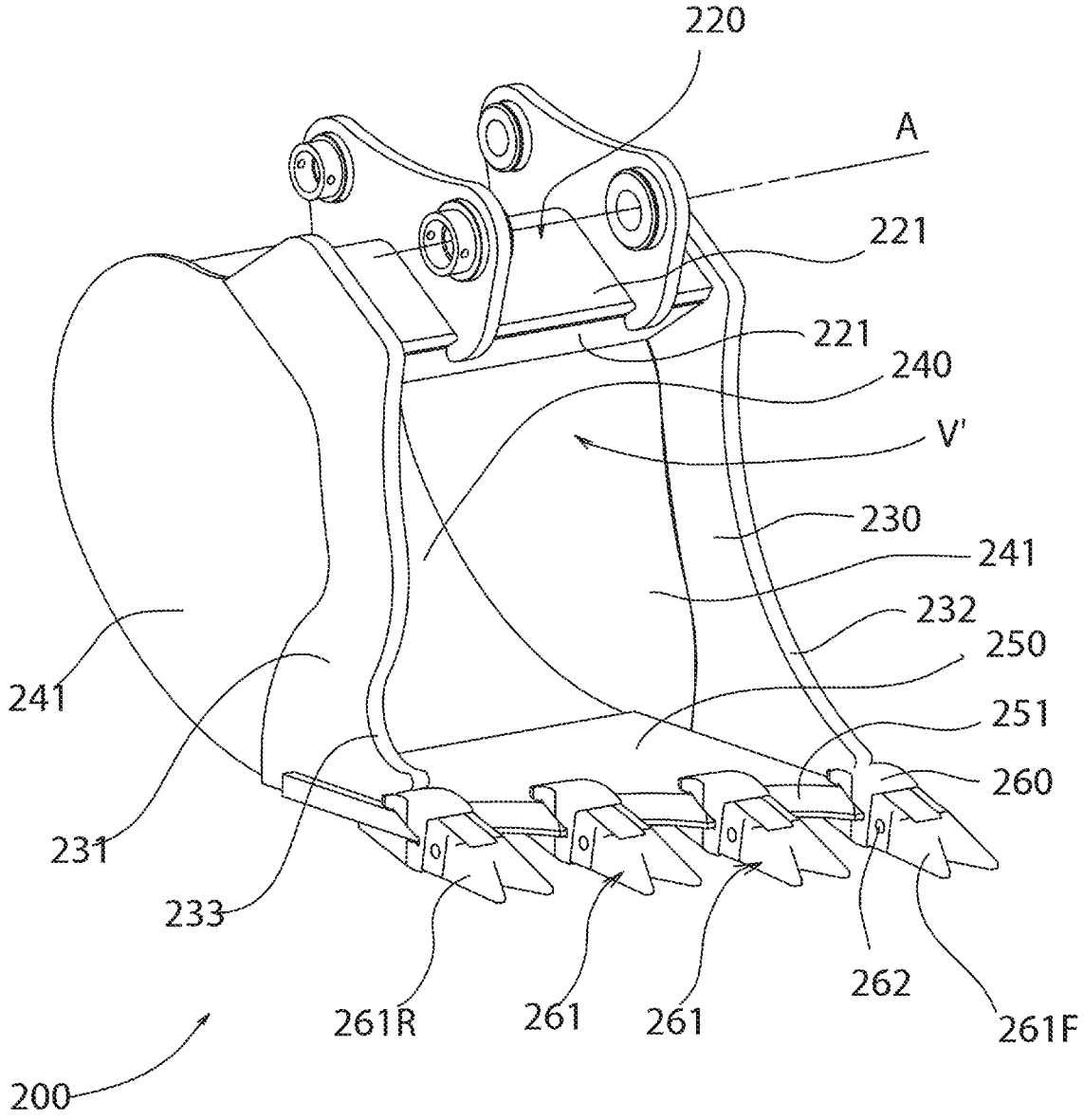
FIG. 5 is a perspective view of a second implementation of a staggered edge excavation tool of the present disclosure having a front leading edge with only a single portion, the single portion disposed at a predetermined angle relative to the direction of substrate engagement motion, i.e., a staggered edge having a single edge portion.
Figure 6:
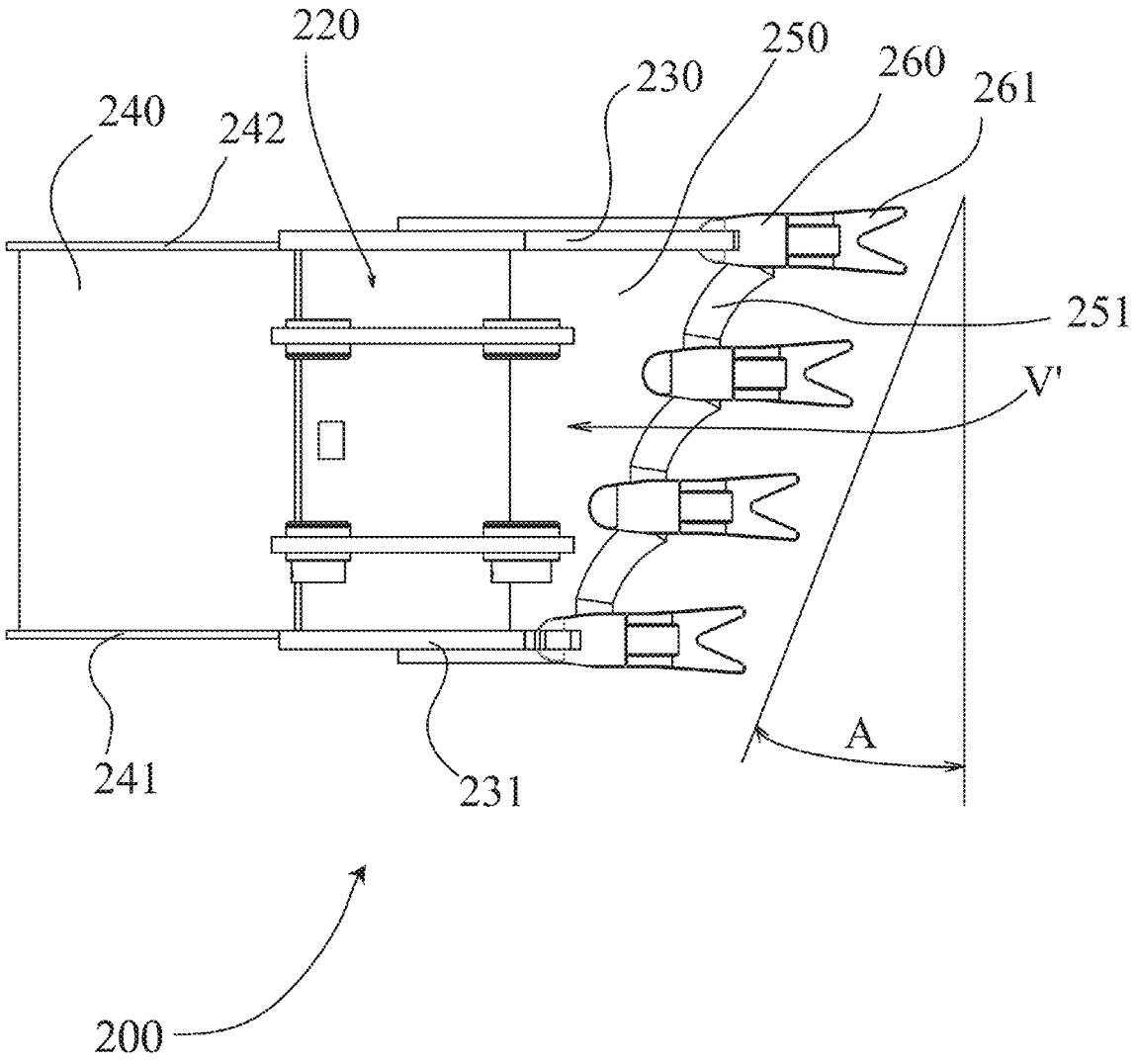
FIG. 6 is a top view of the staggered edge excavation tool of FIG. 5.

Referring to FIGS. 5-6, in a second implementation of a staggered edge excavation tool 200, a front leading edge has only a single portion, with the single portion disposed at a predetermined angle relative to the direction of substrate engagement motion, i.e., a staggered edge having a single edge portion. The arrangement of the staggered edge bucket 200 allows an operator to own a relatively inexpensive bucket while being able to more efficiently excavate hard packed substrate, and also being able to easily shave the bottom of the trench flat, without requiring a tool change or machine change as required in order to use another style bucket. The staggered edge excavation tool 200 has a body 220 for mounting from an arm (not shown), e.g. a dipper arm or a boom arm, and a set of first and second side leading edge plates 230, 231 mounted to the body. The body 220 consists of two plates 221 that form a tube spanning between the side leading edge plates 230 and 231. Each side leading edge plate 230, 231 is perpendicular to an axis of rotation, R', of the tool, and each side leading edge is connected by a front leading edge plate 250 positioned for engagement with a substrate. The front leading edge plate 250 has a single edge portion that is angled laterally by angle, A (FIG. 6), e.g. about 10° to about 35°, and connects the forward side leading edge 232 to the rearward side leading edge 233 shown in FIG. 5. The staggered front leading edge plate 250 shown in the drawings has mounted teeth 261. (Other implementations of the staggered edge excavation tool 200 may or may not have teeth mounted thereto.) The side leading edge plates 230, 231 and teeth 261 are laterally spaced apart along the axis of rotation relative to the arm, and the teeth are positioned in a direction of substrate engagement motion, thus providing a forward side leading edge 232 and tooth 261F (FIG. 5) and a rearward side leading edge 233 and tooth 261R (FIG. 5) that are spaced apart in the direction of bucket motion by distance (e.g., a distance D', e.g., 11 inches for an 30-inch wide bucket or 15 inches for a 40-inch wide bucket) As shown in FIG. 5, additional teeth 261 may be intermediately spaced along the front leading edge 251 of the front leading edge plate 250. All of the teeth 261 and the front leading edge 251 are positioned generally on a flat plane, S, providing a flat bottom on the excavation tool that is generally parallel to the path of rotation.

The top of the forward tooth 261F is set to the optimum excavation angle, B, e.g. about 30°, relative to the axis of rotation, R', to provide maximum penetration in the substrate. The rearward side leading edge plate 231 is shaped to support the front leading edge plate 250 and tooth adapters 260 (to which teeth 261 are mounted, e.g. by pins 262), while also limiting side spillage, thus providing for maximum capacity of excavated material. The front leading edge 251 is scalloped to help slice through the hard packed substrate, e.g. as shown in FIG. 6. The front leading edge 251 is disposed at angle A, as shown in FIG. 6. Ideally, angle A ranges between about 10° and about 35°, but other angles may be employed. A curved back plate 240 as shown in FIG. 5 is mounted to span a region between the side leading edge plates 230 and 231, and the side plates 241, 242, providing a bucket volume, V, of predetermined capacity, e.g. 1.2 cubic yards, for receiving material excavated from the substrate. The tip radius and the width of the staggered edge bucket may be similar to conventional buckets in order to maintain capacities that are also similar.

The staggered edge bucket 200 of FIG. 5 improves the efficiency of excavating hard packed substrate, e.g. as compared to prior art tools, by focusing the breakout force one tooth at a time, while the flat bottom simplifies the operation of forming a flat bottom in the trench. When the operator is excavating hard packed substrate, the bucket is rolled away from the operator, and then lowered, such that the first tooth 261F engages the material first. The concentration of machine breakout force on one tooth provides a concentration of the forces that are high enough to easily break up hard packed substrate. As the bucket is rolled toward the operator and lowered, the second tooth, i.e. the tooth 261 next adjacent to tooth 261F, engages the substrate. Looking only at the second tooth, because the second tooth is closer to the arm bucket pin location of rotation (axis, R'), the force on this tooth will be relatively higher, i.e. than the force on the first tooth, and also because the teeth are positioned in a flat plane, the angle, B''' for the second tooth, e.g. 32°, is relatively larger than the angle, B'', for the first tooth, e.g., the angle for the first tooth is about 30°. This relatively larger angle, B''', creates a greater material slicing effect than the smaller angle, B'', on the first tooth. Looking at the first and the second tooth together, the first tooth engages with the hard packed substrate with full breakout force. When the second tooth engages the substrate, some of the load is shared with the first tooth, and as subsequent teeth engage with the hard packed substrate, the load is shared between each subsequent tooth until all of the teeth have engaged with the substrate. When all of the teeth have engaged with the substrate, the efficiency is only slightly better than a conventional bucket. Throughout a good portion of the digging of the hard packed substrate, the bucket will have all teeth engaged; however, when the material becomes difficult to dig the operator will know to position the bucket so that relatively fewer teeth are engaged, thus providing relatively higher forces for simplifying the excavation of the hard packed substrate.

The bucket volume, V', of the staggered edge bucket 200 fills and empties easily, permitting the operator to scoop all excavated materials. When the operator has excavated to the bottom of the trench to where he/she would like to produce a flat bottom, the staggered edge bucket can be positioned flat and can be forced laterally using the machine hydraulics, to shave the trench bottom material to produce a perfectly flat bottom, G. This technique is similar to the technique used with a conventional bucket.

A number of embodiments of the invention have been described. Nevertheless, it will be understood that various modifications may be made without departing from the spirit and scope of the invention. For example, the side leading edge plates 30, 31, of the staggered edge bucket 10 may be fitted with replaceable bolt-on or weld-on side cutters for severe applications. Also, the front leading edges could be a separate bolt-on or weld-on aftermarket assembly for existing buckets. Also, the excavation tool of the disclosure could be used on wheel-type, crawler-type and skid steer-type loaders or shovels. Additionally, teeth 161A-161D can be arranged to engage the substrate in a sequence different than sequence described above, for example in the order of 161A, 161B, 161D, 161 C. Accordingly, other implementations are within the scope of the following claims.

What is claimed is:

1. A staggered edge bucket excavation tool for use mounted to an arm of an excavation machine and having an axis of rotation relative to the arm, said staggered edge bucket excavation tool comprising:

a body mounted for rotation from the arm;

a pair of generally flat, side leading edge plates mounted to the body;

a formed back sheet mounted to said body and to said side leading edge plates; and a planar plate having a staggered front leading edge with a first front edge portion and a second front edge portion disposed at contrasting angles relative to each other and to the direction of substrate engagement motion, the planar plate being mounted to span the region of the staggered edge bucket between said side leading edge plates, and attached to said formed back sheet and said side plates, to define, together, a staggered edge bucket volume for receiving material excavated from a hard packed substrate during excavation action, and wherein said staggered edge bucket excavation tool further comprises:

a set of three or more teeth mounted with uniform lateral spacing along the first and second front edge portions of the staggered front leading edge of the planar plate, wherein:

each tooth of the set of three or more teeth defines a forward surface, with the forward surface of each tooth of the set of three or more teeth being arranged in non-alignment with the forward surfaces of all other teeth of said set of three or more teeth, the forward surfaces of the teeth of the set of three or more teeth having uniform spacing in the direction of, and in the sequence of, substrate engagement motion, and the teeth of the set of three or more teeth are thereby disposed and arranged for individual, sequential engagement, with the hard packed substrate during excavation action along each of the first and second front edge portions, with the individual, sequential engagement of the teeth occurring one tooth at a time, alternately on one of the first and second front edge portions and then on the other of the first and second front edge portions, and the set of three or more teeth defines a flat plane lying generally parallel to the planar plate, and each tooth of said set of three or more teeth defines an excavation angle measured between a surface of said tooth and said axis of rotation, and said excavation angle of each tooth of said set of three or more teeth is different from the excavation angles of all other teeth of said set of three or more teeth.

2. The staggered edge bucket excavation tool of claim 1, wherein each of said first and second front edge portions of said staggered front leading edge of said planar plate defines scalloped front leading edge segments between teeth of the set of three or more teeth, with the contrasting angles of the first and second front edge portions defined by the forward surfaces of the teeth of the set of three or more teeth along each of the first and second front edge portions.

* * * * *